US008307569B2

(12) United States Patent
McInnis et al.

(10) Patent No.: US 8,307,569 B2
(45) Date of Patent: Nov. 13, 2012

(54) TRAINING FOOTWEAR

(75) Inventors: William McInnis, Westwood, MA (US); Michael Andrews, East Falmouth, MA (US); Kevin Leary, Dedham, MA (US); Ricardo Vestuti, Providence, RI (US); Paul E. Litchfield, Westboro, MA (US)

(73) Assignee: Reebok International Limited, London (GB)

( * ) Notice: Subject to any disclaimer, the term of this patent is extended or adjusted under 35 U.S.C. 154(b) by 704 days.

(21) Appl. No.: 12/416,698

(22) Filed: Apr. 1, 2009

(65) Prior Publication Data

US 2010/0251567 A1 Oct. 7, 2010

(51) Int. Cl.
*A43B 13/20* (2006.01)
*A43B 13/18* (2006.01)

(52) U.S. Cl. ..... 36/28; 36/29; 36/35 B; 36/114

(58) Field of Classification Search ..... 36/28, 29, 36/35 R, 35 B, 114
See application file for complete search history.

(56) References Cited

U.S. PATENT DOCUMENTS

| | | | | |
|---|---|---|---|---|
| D39,747 | S | 1/1909 | McKenna | |
| 1,272,556 | A | 7/1918 | Steward | |
| 1,979,972 | A | 11/1934 | Guild | |
| D123,602 | S | 11/1940 | Reeves | |
| D125,657 | S | 3/1941 | Cutler | |
| D234,930 | S | 4/1975 | Arambasic et al. | |
| D265,690 | S | 8/1982 | Famolare, Jr. | |
| D266,798 | S | 11/1982 | Famolare, Jr. | |
| D267,288 | S | 12/1982 | Davis | |
| D267,366 | S | 12/1982 | Davis | |
| 4,446,634 | A * | 5/1984 | Johnson et al. | 36/29 |
| 4,571,852 | A | 2/1986 | Lamarche et al. | |
| 4,577,417 | A | 3/1986 | Cole | |
| 4,653,206 | A | 3/1987 | Tanel | |
| 4,897,936 | A | 2/1990 | Fuerst | |
| D323,059 | S | 1/1992 | Hatfield | |
| D343,051 | S | 1/1994 | Bramani | |
| 5,313,718 | A | 5/1994 | McMahon et al. | |
| 5,416,986 | A * | 5/1995 | Cole et al. | 36/29 |
| D394,939 | S | 6/1998 | Avar | |
| D395,157 | S | 6/1998 | von Conta | |
| 5,771,606 | A | 6/1998 | Litchfield et al. | |
| D396,549 | S | 8/1998 | von Conta et al. | |

(Continued)

FOREIGN PATENT DOCUMENTS

EP 1 120 056 A2 8/2001

(Continued)

OTHER PUBLICATIONS

U.S. Appl. No. 12/571,327, Litchfield et al., filed Sep. 30, 2009.

(Continued)

*Primary Examiner* — Marie Patterson
(74) *Attorney, Agent, or Firm* — Sterne, Kessler, Goldstein & Fox P.L.L.C.

(57) ABSTRACT

Articles of footwear are disclosed. In one embodiment, an article of footwear comprises a sole having a forefoot portion and a heel portion. The sole comprises a midsole, an intermediate sole, and a ground contacting surface. At least a portion of the intermediate sole extends from the midsole such that a forefoot bulge substantially covers the forefoot portion of the ground contacting surface and a heel bulge substantially covers the heel portion of the ground contacting surface.

38 Claims, 10 Drawing Sheets

U.S. PATENT DOCUMENTS

| | | | | |
|---|---|---|---|---|
| D398,440 | S | 9/1998 | Rowland | |
| 5,806,209 | A * | 9/1998 | Crowley et al. | 36/28 |
| D400,344 | S | 11/1998 | Avar | |
| D401,043 | S | 11/1998 | Truelsen | |
| D405,596 | S | 2/1999 | Aird et al. | |
| 5,956,869 | A * | 9/1999 | Kim | 36/29 |
| 6,018,889 | A * | 2/2000 | Friton | 36/28 |
| 6,038,790 | A * | 3/2000 | Pyle et al. | 36/30 R |
| D426,947 | S | 6/2000 | Pollastrelli | |
| 6,354,020 | B1 * | 3/2002 | Kimball et al. | 36/29 |
| 6,505,420 | B1 | 1/2003 | Litchfield et al. | |
| D482,852 | S | 12/2003 | Belley et al. | |
| D492,096 | S | 6/2004 | Sanchez et al. | |
| 6,745,499 | B2 | 6/2004 | Christensen et al. | |
| 6,754,981 | B1 * | 6/2004 | Edwards | 36/29 |
| 6,845,573 | B2 * | 1/2005 | Litchfield et al. | 36/29 |
| D501,293 | S | 2/2005 | Bizzo | |
| D504,555 | S | 5/2005 | Urie | |
| 6,979,287 | B2 | 12/2005 | Elbaz et al. | |
| 7,080,467 | B2 | 7/2006 | Marvin et al. | |
| 7,101,330 | B2 | 9/2006 | Elbaz et al. | |
| D532,189 | S | 11/2006 | Truelsen | |
| 7,200,955 | B2 * | 4/2007 | Foxen | 36/25 R |
| D553,335 | S | 10/2007 | Amado et al. | |
| D569,084 | S | 5/2008 | Hatfield et al. | |
| D576,394 | S | 9/2008 | Heller | |
| 7,475,498 | B2 * | 1/2009 | Litchfield et al. | 36/29 |
| 2003/0101619 | A1 * | 6/2003 | Litchfield et al. | 36/29 |
| 2004/0033864 | A1 | 2/2004 | Elbaz et al. | |
| 2004/0033874 | A1 | 2/2004 | Elbaz et al. | |
| 2005/0268490 | A1 | 12/2005 | Foxen | |
| 2005/0283999 | A1 | 12/2005 | Whatley | |
| 2008/0242518 | A1 | 10/2008 | Elbaz et al. | |
| 2009/0165333 | A1 * | 7/2009 | Litchfield et al. | 36/88 |

FOREIGN PATENT DOCUMENTS

| | | | |
|---|---|---|---|
| WO | WO 2004/016321 | A2 | 2/2004 |
| WO | WO 2004/016321 | A3 | 2/2004 |

OTHER PUBLICATIONS

The Times, Body + Soul article, p. 7-8, Sep. 26, 2009.

Apos, Less Pain, More Function article, 12 pages, copyright 2008.

European Search Report for EP 09 17 9450, completed Jul. 23, 2010.

Flexyboots article, 2 pages.

Draft Flexyboots BmbH Patent Application dated Aug. 20, 2008, retrieved on Jun. 26, 2009 from http://www.flexiboots.ch/Patent.pdf, 42 pages.

Reebok Fall 2002 Footwear Catalog, p. 14, showing the U-Shuffle DMX shoe.

Reebok Third Quarter 2003 Footwear Catalog, p. 17, showing the Stimulus DMX shoe, and pp. 16 and 41, showing the Court Macabee II DMX shoe.

Reebok Spring 2005 Footwear Catalog, p. 30, showing the Sportcentric DMX Max shoe, p. 31, showing the Destination DMX shoe, and pp. 32 and 52, showing the Trail DMX Max and Sporterra DMX Walk shoes.

Reebok Third Quarter 2005 Footwear Catalog, p. 50, showing the Sportcentric DMX Max shoe.

Reebok First Quarter 2007 Footwear Catalog, pp. 16 and 53, showing the Voyage Mid III and Voyage Low III shoes.

* cited by examiner

TRAINING FOOTWEAR

BACKGROUND OF THE INVENTION

1. Field of the Invention

Embodiments of the present invention generally relate to footwear, and more particularly relate to exercise related footwear.

2. Background of the Invention

One of the problems associated with footwear, especially athletic shoes, has always been striking a balance between support and cushioning. Throughout the course of an average day, the feet and legs of an individual are subjected to substantial impact forces. Running, jumping, walking, and even standing exert forces upon the feet and legs of an individual which can lead to soreness, fatigue, and injury.

The human foot is a complex and remarkable piece of machinery, capable of withstanding and dissipating many impact forces. The natural padding of fat at the heel and forefoot, as well as the flexibility of the arch, help to cushion the foot.

An athlete's stride is partly the result of energy which is stored in the flexible tissues of the foot. For example, a typical gait cycle for running or walking begins with a "heel strike" and ends with a "toe-off". During the gait cycle, the main distribution of forces on the foot begins adjacent to the lateral side of the heel (outside of the foot) during the "heel strike" phase of the gait, then moves toward the center axis of the foot in the arch area, and then moves to the medial side of the forefoot area (inside of the foot) during "toe-off". During a typical walking or running stride, the achilles tendon and the arch stretch and contract, storing and releasing energy in the tendons and ligaments. When the restrictive pressure on these elements is released, the stored energy is also released, thereby reducing the burden which must be assumed by the muscles.

Although the human foot possesses natural cushioning and rebounding characteristics, the foot alone is incapable of effectively overcoming many of the forces encountered during athletic activity. Unless an individual is wearing shoes which provide proper cushioning and support, the soreness and fatigue associated with athletic activity is more acute, and its onset accelerated. The discomfort for the wearer that results may diminish the incentive for further athletic activity. Equally important, inadequately cushioned footwear can lead to injuries such as blisters, muscle, tendon and ligament damage, and bone stress fractures. Improper footwear can also lead to other ailments, including back pain.

Proper footwear should complement the natural functionality of the foot, in part, by incorporating a sole (typically including an outsole, midsole and insole) which absorbs shocks. However, the sole should also possess enough resiliency to prevent the sole from being "mushy" or "collapsing," thereby unduly draining the stored energy of the wearer. In light of the above, numerous attempts have been made to incorporate into a shoe improved cushioning and resiliency. For example, attempts have been made to enhance the natural resiliency and energy return of the foot by providing shoes with soles which store energy during compression and return energy during expansion. These attempts have included the formation of shoe soles that include springs, gels or foams such as ethylene vinyl acetate (EVA) or polyurethane (PU). However, all of these tend to either break down over time or do not provide adequate cushioning characteristics.

Another concept practiced in the footwear industry to improve cushioning and energy return has been the use of fluid-filled systems within shoe soles. These devices attempt to enhance cushioning and energy return by transferring a pressurized fluid between the heel and forefoot areas of a shoe. The basic concept of these devices is to have cushions containing pressurized fluid disposed adjacent the heel and forefoot areas of a shoe.

While wearing footwear with appropriate cushioning and support can help to minimize injuries, individuals can further limit injuries and improve their overall physical conditioning by participating in a regular exercise program. There are many activities in daily life that require individuals to use their strength, agility, and balance, and maintaining physical fitness can help individuals complete these activities with minimum disruption to their lives. Maintaining physical fitness has also been shown to strengthen the heart, boost HDL cholesterol, aid the circulatory system, and lower blood pressure and blood fats, translating to lower risk for heart disease, heart attack, and stroke. Exercise also strengthens muscles, increases flexibility, and promotes stronger bones, which can help prevent osteoporosis.

In today's society, many individuals struggle to maintain basic levels of fitness. Time is one of the main roadblocks to maintaining a consistent training program, both for the elite athlete and the individual struggling to maintain physical fitness. There is an ever-increasing amount of demand on a person's free time.

In response to these concerns, over the years companies have developed various forms of exercise equipment and training programs designed to maximize the efficiency of an individual's training. The equipment and programs often achieve the desired result—reducing the amount of time investment necessary to maintain physical fitness. However, these methods still require an individual to allocate a block of time out of the individual's schedule for a workout.

Thus, there is a need for a training aid that allows a user to incorporate a workout into his or her daily routine while minimizing the time investment required.

BRIEF SUMMARY OF THE INVENTION

Embodiments of the present invention relate to an article of footwear, comprising: a sole having a forefoot portion and a heel portion, the sole comprising a midsole, an intermediate sole, and a ground contacting surface (e.g., a primary ground contacting surface), wherein at least a portion of the intermediate sole extends from the midsole such that a forefoot bulge substantially covers the forefoot portion of the ground contacting surface and a heel bulge substantially covers the heel portion of the ground contacting surface.

Embodiments of the present invention also relate to an article of footwear, comprising: a sole having a forefoot portion and a heel portion, the sole comprising a midsole, an intermediate sole, and a ground contacting surface (e.g., a primary ground contacting surface), wherein at least a portion of the intermediate sole is disposed in the midsole and at least half of the intermediate sole extends from the midsole in the forefoot portion and the heel portion such that only one forefoot bulge is disposed in the forefoot portion of the ground contacting surface and only one heel bulge is disposed in the heel portion of the ground contacting surface.

Embodiments of the present invention further relate to an article of footwear, comprising: a sole having a forefoot portion and a heel portion, the sole comprising: a midsole having a cavity formed therein, a resilient insert partially disposed in the midsole cavity having a forefoot chamber, a heel chamber, and a passageway fluidly connecting the forefoot chamber and the heel chamber, and a ground contacting surface (e.g., a primary ground contacting surface), wherein a greater portion of the resilient insert than the portion disposed in the midsole cavity extends from the midsole in the forefoot portion and the heel portion such that a forefoot bulge corresponding with the forefoot chamber substantially covers the forefoot portion of the ground contacting surface and a heel bulge corresponding with the heel chamber substantially covers the heel portion of the ground contacting surface.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

Figure 1:
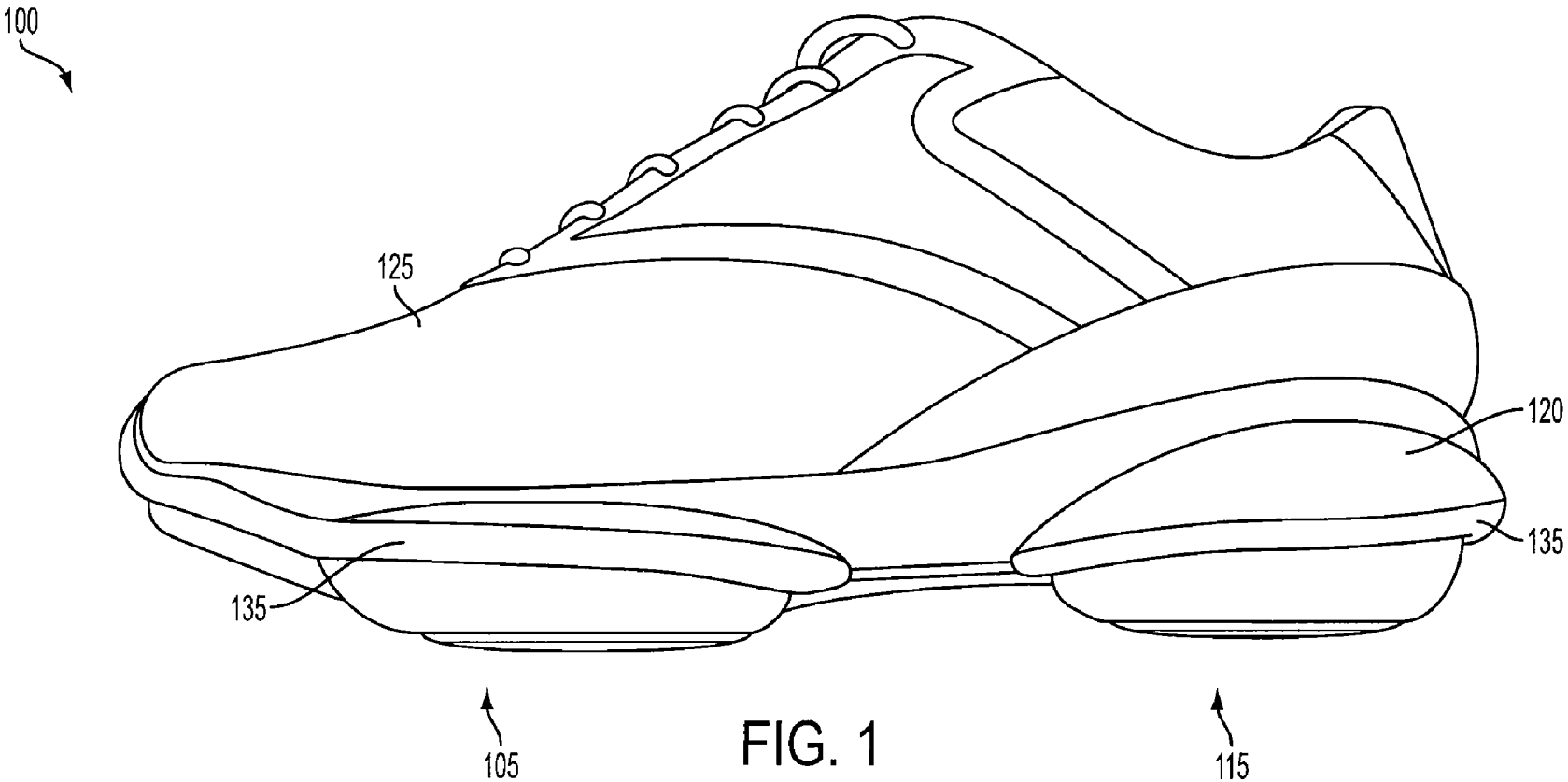
FIG. 1 is a lateral side view of a shoe according to an embodiment of the present invention.

The present invention will now be described in detail with reference to embodiments thereof as illustrated in the accompanying drawings, in which like reference numerals are used to indicate identical or functionally similar elements. References to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

The following examples are illustrative, but not limiting, of the present invention. Other suitable modifications and adaptations of the variety of conditions and parameters normally encountered in the field, and which would be apparent to those skilled in the art, are within the spirit and scope of the invention.

Referring to the drawings and in particular to FIG. 1, an exemplary embodiment of an article of footwear, in particular a shoe, according to the present invention generally referred to by reference numeral 100 is shown. Although the article of footwear 100 may be referred to herein as shoe 100, it is contemplated that it may comprise any type of footwear in which the sole of the present invention may be desirable, including, but not limited to, walking shoes, running shoes, basketball shoes, court shoes, tennis shoes, training shoes, boots, and sandals.

The shoe 100 has a forefoot portion 105 and a heel portion 115, and includes an upper 125, a midsole 120, intermediate sole 130 (not shown in FIG. 1) and an outsole 135. In one embodiment of the present invention, an insole and/or sockliner may also be included within the shoe 100. In some embodiments, the midsole 120 may include the insole and/or sockliner. The outsole 135 may comprise a wear-resistant material. For example, outsole 135 can include synthetic or natural rubber, thermoplastic polyurethane (TPU), a wear-resistant foam, or a combination thereof. The midsole 120 may comprise a foam such as, for example, ethylene vinyl acetate (EVA) or polyurethane. In some embodiments, the midsole can include a molded thermoplastic component such as, for example, an injection molded TPU component. In one specific embodiment, the midsole is substantially composed of a molded thermoplastic such as, for example, an injection molded TPU. Alternatively, the materials comprising the outsole 135 and the midsole 120 may be chosen as deemed fit by one of skill in the art.

Figure 2:
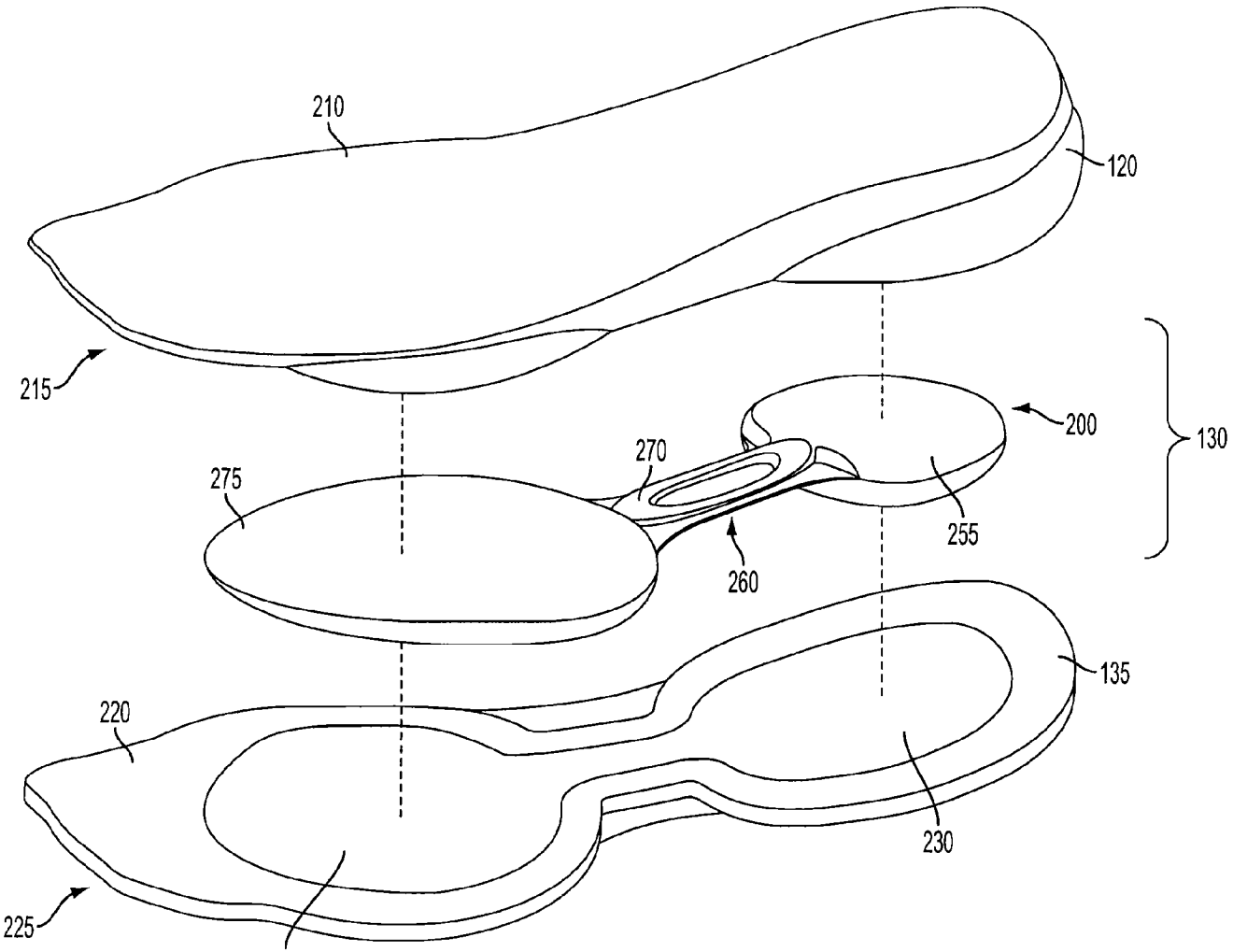
FIG. 2 is an exploded view of a midsole, intermediate sole, and outsole according to an embodiment of the present invention.
Figure 6:
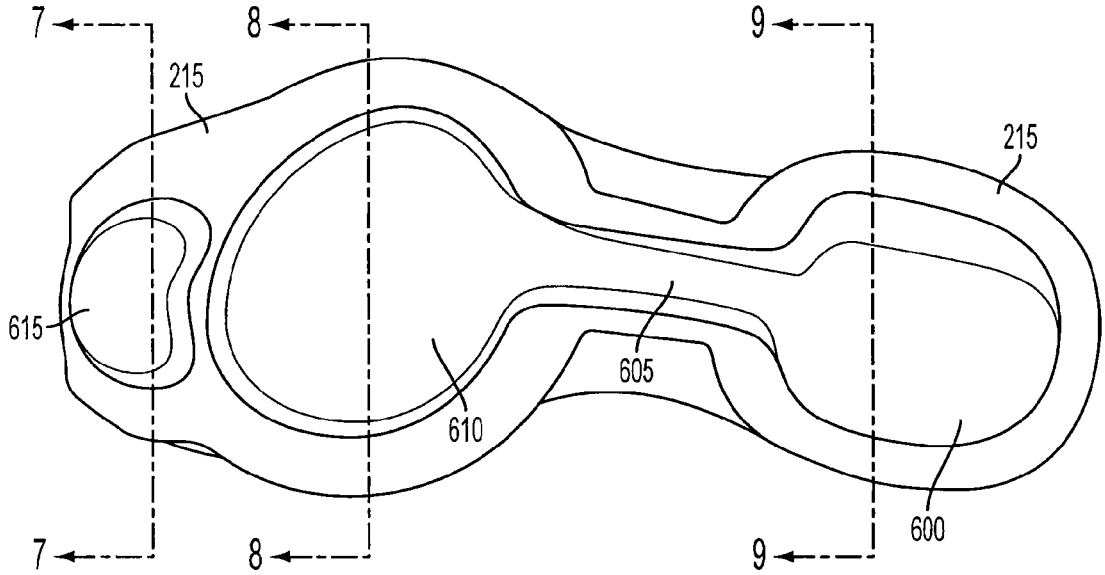
FIG. 6 is a bottom plan view of a midsole according to an embodiment of the present invention.
Figure 7:
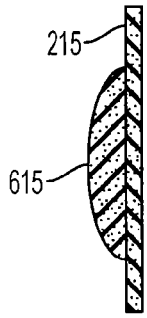
FIG. 7 is a cross-sectional view of the midsole taken along the line 7-7 in FIG. 6 according to an embodiment of the present invention.
Figure 8:
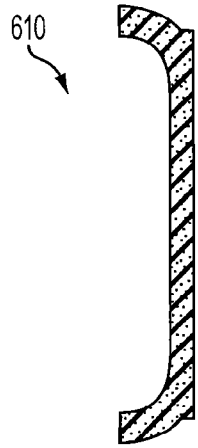
FIG. 8 is a cross-sectional view of the midsole taken along the line 8-8 in FIG. 6 according to an embodiment of the present invention.
Figure 9:
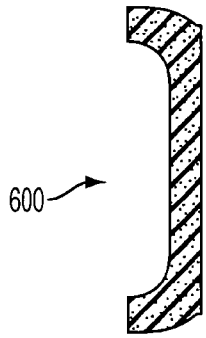
FIG. 9 is a cross-sectional view of the midsole of the present invention taken along the line 9-9 in FIG. 6 according to an embodiment of the present invention.

With reference to FIG. 2, in one embodiment of the present invention a sole includes the midsole 120, the outsole 135, and the intermediate sole 130. In one embodiment, the intermediate sole 130 comprises a resilient insert 200. The midsole 120 has a top surface 210 and a bottom surface 215. A heel cavity 600 and a forefoot cavity 610 are formed in the bottom surface of the midsole 120, as shown in FIGS. 6, 8, and 9. Similarly, the outsole 135 has a bottom surface 225 and a top surface 220 in which are formed a heel cavity 230 and a forefoot cavity 240. The midsole and outsole cavities are formed to accommodate the resilient insert 200 when the sole is assembled. To form the sole construction shown in FIG. 1, the top and sides of resilient insert 200 may be secured in the midsole and/or outsole cavities, for example, by a bonding adhesive. Suitable bonding adhesives include water-based adhesives and solvent-based adhesives such as, for example, urethane adhesives and ethylene vinyl acetate adhesives. The top surface 220 of the outsole 135 is then secured to the bottom surface 215 of midsole 120, for example, by using the same or a similar bonding adhesive. In addition, the bottom of resilient insert 200 may be secured to the top surface 220 of the outsole 135 using a bonding adhesive.

The intermediate sole 130 comprises a structure disposed between midsole 120 and outsole 135. In one embodiment of the present invention, the intermediate sole 130 comprises a resilient insert 200. As used herein, the term "insert" is not intended to be limiting. For example, in some embodiments of the present invention, the resilient insert 200 may be permanently placed in the shoe 100 during manufacturing and not separable therefrom. In certain embodiments, resilient insert 120 can be an integral part of midsole 120 or outsole 135. For example, midsole 120 or outsole 135 can be molded having resilient insert 120 integral therewith.

Figure 10:
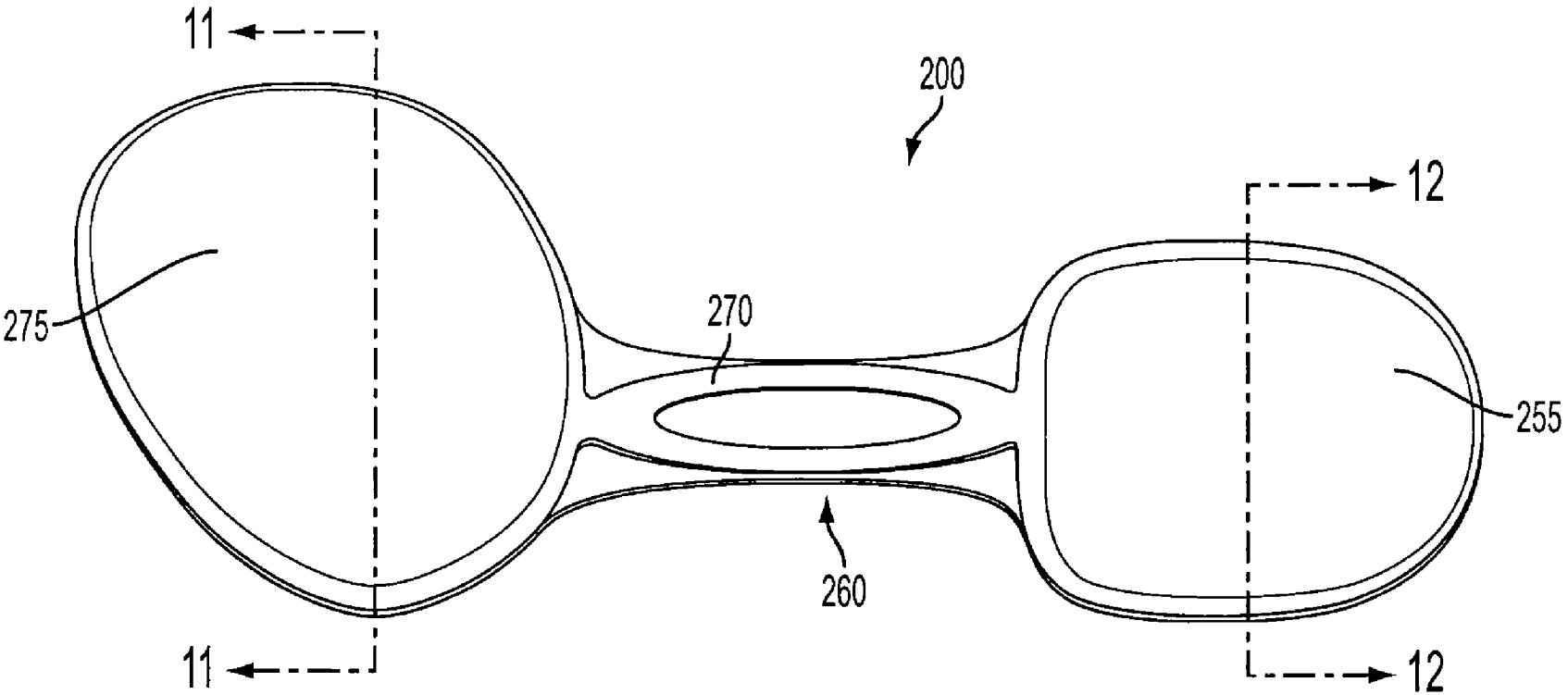
FIG. 10 is a top plan view of an intermediate sole according to an embodiment of the present invention.
Figure 11:
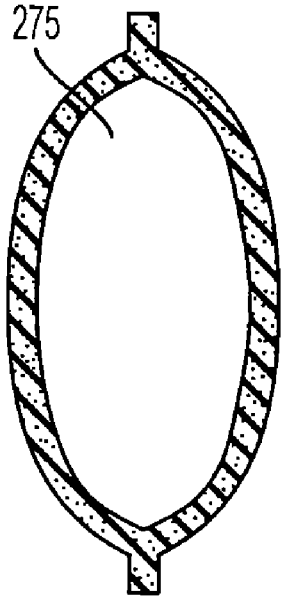
FIG. 11 is a cross-sectional view of the intermediate sole of the present invention taken along the line 11-11 in FIG. 10 according to an embodiment of the present invention.
Figure 12:
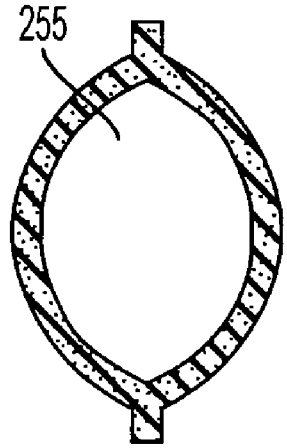
FIG. 12 is a cross-sectional view of the intermediate sole of the present invention taken along the line 12-12 in FIG. 10 according to an embodiment of the present invention.
Figure 13:
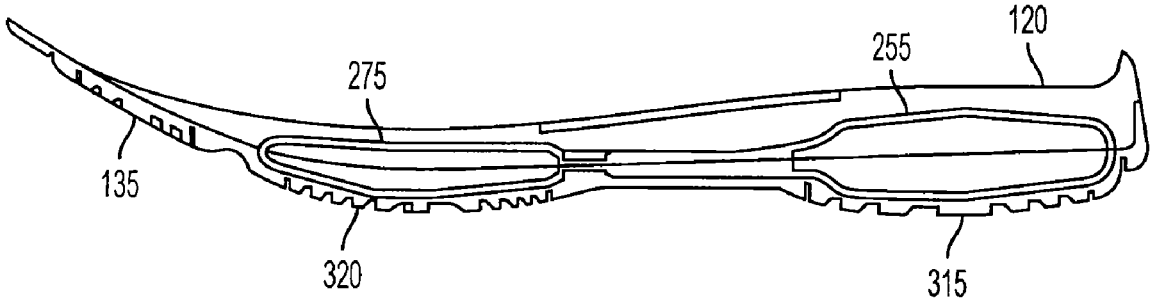
FIG. 13 is a cross-sectional view of an article of footwear according to an embodiment of the present invention.
Figure 14:
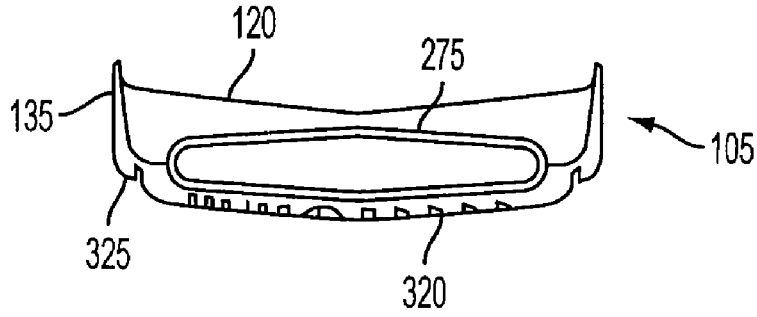
FIG. 14 is a cross-sectional view of the article of footwear taken along the line 14-14 in FIG. 3 according to an embodiment of the present invention.
Figure 15:
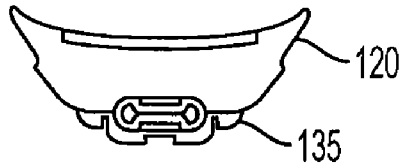
FIG. 15 is a cross-sectional view of the article of footwear taken along the line 15-15 in FIG. 3 according to an embodiment of the present invention.
Figure 16:
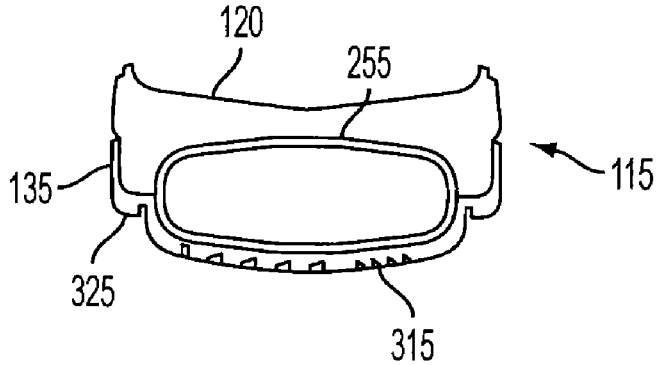
FIG. 16 is a cross-sectional view of the article of footwear taken along the line 16-16 in FIG. 3 according to an embodiment of the present invention.

In one embodiment of the present invention, with reference to FIGS. 2 and 10, the resilient insert 200 comprises a top surface and a bottom surface. Together, the top and bottom surfaces generally define at least one heel chamber 255, at least one forefoot chamber 275, and a passageway 260. In some instances, as illustrated in FIGS. 2 and 10, the top and bottom surfaces generally define a single heel chamber 255, a single forefoot chamber 275, and a passageway 260. In one embodiment, the top and bottom as well as the sides of resilient insert 200 may be mirror images of one another and, in light of its symmetrical nature, resilient insert 200 may be incorporated in either a left or right shoe by merely turning the resilient insert over to its reverse side.

With continuing reference to FIGS. 2 and 10, passageway 260 fluidly connects heel chamber 255 to forefoot chamber 275 to permit a contained material (e.g., a fluid, a gel, a paste, or flowable particles) to flow between the chambers in response to forces applied to the bottom of the wearer's foot.

In one embodiment, the resilient insert shown in FIGS. 2 and 10 may comprise a structure similar to that disclosed in U.S. Pat. No. 6,745,499 to Christensen, et al., incorporated herein in its entirety by reference. Resilient insert 200 provides continuous cushioning to the wearer's foot, such that a wearer's stride forces a material (e.g., a fluid, a gel, a paste, or flowable particles) within the resilient insert to flow in a manner complementary with respect to the wearer's stride and the application of forces to the anatomical structure of the foot. Resilient insert 200 can be formed of a suitably resilient material so that it can compress with the application of force and expand with the delivery of a material (e.g., a fluid, a gel, a paste, or flowable particles), while also resisting breakdown.

In one embodiment, passageway 260 may comprise an impedance structure 270 which acts as a regulator to control the flow of a material as it flows from one chamber to the other. While impedance structure 270 is shown with a specific construction in the figures, it should be understood that other impedance structures could be utilized in resilient insert 200, including those disclosed in International Patent Publication No. PCT/US94/00895 by Reebok International Ltd. and U.S. Pat. No. 5,771,606 to Litchfield, et al., the disclosures of which are incorporated herein in their entirety by reference thereto.

It should be understood that alternate resilient insert constructions can be used in practice of the present invention. In one embodiment, the resilient insert includes at least two discrete pieces (e.g., discrete fluid, gel, paste, or particle-containing chambers), at least one first discrete piece being housed in a forefoot cavity and at least one second discrete piece being housed in a heel cavity. In such embodiments, the at least two discrete pieces are not in fluid communication with each other. In other embodiments, resilient insert includes at least two chambers in fluid communication with each other and also at least one discrete piece that is not in fluid communication either with another discrete piece or with the at least two chambers.

Resilient insert 200 can be formed of a polymer such as an elastomer and can be formed using any of various molding techniques known in the art. For example, resilient insert 200 can be blow molded, such as by injection blow molding or stretch blow molding. Further, other manufacturing methods can be used to form resilient insert 200, such as thermoforming and sealing, injection molding and sealing, vacuum forming and sealing or radio frequency (RF)/high frequency (HF) welding. In some instances, an aperture is used to fill the resilient insert with a fluid (e.g., a liquid or a gas such as ambient or pressurized air at a pressure greater than ambient air); a gel; a paste, particles (e.g., polymer particles, foam particles, cellulose particles, rock or mineral particles, rubber particles, and the like), or a combination thereof. In some instances, the resilient insert contains air or other suitable gases at a pressure greater than ambient air.

In some instances, the resilient insert includes a fluid-filled bladder. In other instances, the resilient insert is a fluid-filled bladder. The bladder may be filled with a gas such as, for example, pressurized or non-pressurized (ambient) air. Fluid filled bladders suitable for use in footwear include, but are not limited to, bladders like those described in U.S. Pat. Nos. 7,395,617 to Christensen, et al. and 7,340,851 to Litchfield, et al., the disclosures of which are incorporated herein in their entirety by reference.

In some embodiments, resilient insert 200 can be customized to suit the wearer, either by the retailer or manufacturer or by the wearer. For example, pressure of a fluid within the resilient insert can be altered according to a wearer's preference such as to achieve a desired shoe feel or performance. By altering the pressure within the resilient insert, a wearer can alter stability of the shoe and, thereby, the exertion level for the wearer or the muscle activity required of the wearer.

In some embodiments, an inflation system, such as an air pump and release mechanism, can be used to alter the pressure of a fluid within the resilient insert. Examples of an inflation system suitable for use with the resilient insert include inflation systems having pumps actuated by the pressure exerted by a wearer's foot, pumps actuated by a wearer's hand, electronically actuated pumps, and automatically actuated pumps. In addition, inflation systems can contain one or more of the following: valves, one-way valves, release valves, pressure regulators, manifolds, conduit, pressure transducers, automated or electronic control systems, power sources, air inlets, and pressurized gas sources.

In other embodiments, the resilient insert includes at least two chambers in fluid communication and a valve to prevent or restrict flow of a material (e.g., a fluid, a gel, a paste, or particles) between the chambers. A user can alter the position of the valve to achieve a desired shoe feel or performance. Alternatively, the valve can be electronically actuated or automatically actuated.

Alternate materials could also be used to form intermediate sole 130. For example, intermediate sole 130 can also be formed of a visco-elastic material, EVA, polyurethane foam, or any other material such as silicone or cast urethane. Intermediate sole 130 can be formed of a single piece of material or multiple discrete pieces, may be formed with or without material in the arch region of the sole, and may be solid, porous, or hollow. In some embodiments, the intermediate sole 130 can be formed of discrete pieces of material, layers of materials, structured materials (e.g., honeycomb structured materials), or a combination thereof. Components of the intermediate sole 130 can be formed by various techniques known in the art such as, for example, die cutting, compression molding, injection molding, and blow molding.

In one embodiment, intermediate sole 130 may further comprise a fluid-filled bladder. The bladder may be filled with a gas such as, for example, pressurized or non-pressurized (ambient) air. The bladder may operate similar to the resilient insert such that a wearer's stride forces air within the bladder to flow in a manner complementary with respect to the wearer's stride and the application of forces to the anatomical structure to the foot. In some embodiments, the bladder can be customized to suit the wearer, either by the retailer or manufacturer or by the wearer. Accordingly, the intermediate sole can contain a fluid control or an inflation system for use with a bladder, such as those described supra for use with a resilient insert.

In an alternative embodiment, intermediate sole 130 may comprise a foam or a foam insert having one or more different physical properties (e.g., density) than those of midsole 120. For example, intermediate sole 130 can include polyurethane foam, EVA foam, an open-celled foam, a closed-cell foam, or a reticulated foam having different physical properties than those of midsole 120. In certain preferred embodiments, intermediate sole 130 includes a foam through which fluid, such as air, can flow from forefoot to heel and from heel to forefoot. For example, intermediate sole 130 can include an open-celled foam or a foam with longitudinal fluid channels therein.

Figure 3:
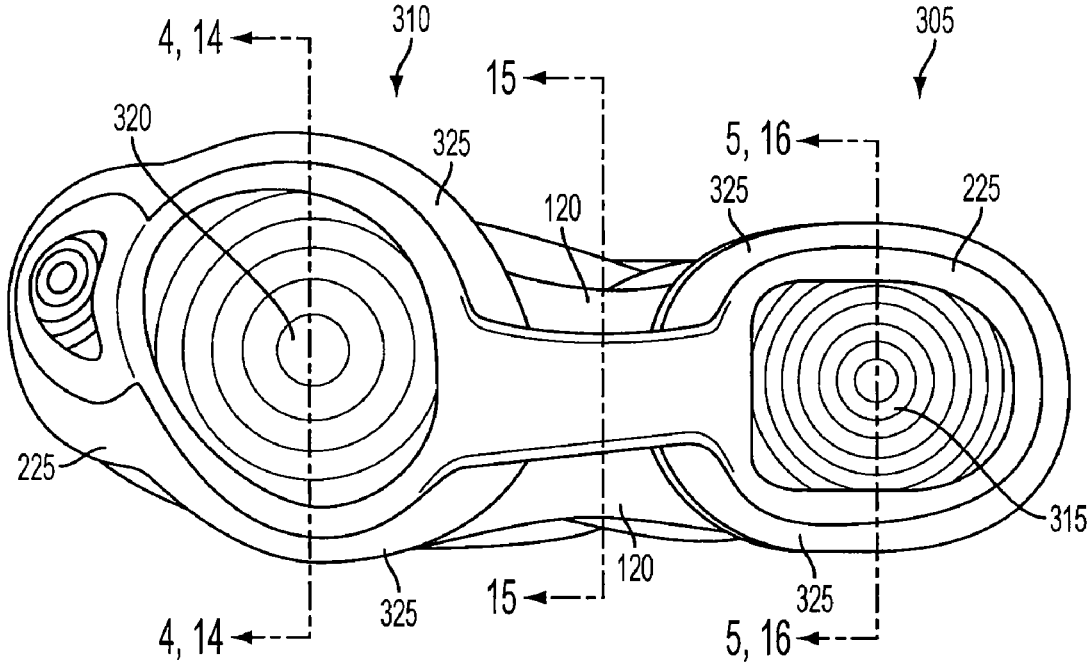
FIG. 3 is a bottom plan view of an article of footwear according to an embodiment of the present invention.
Figure 4:
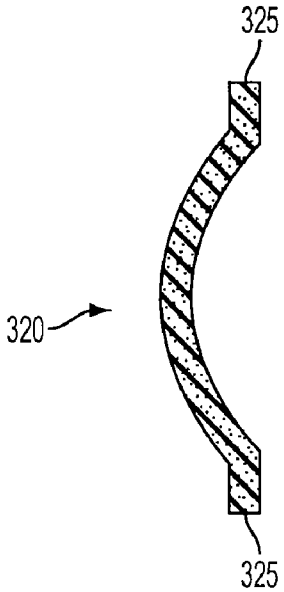
FIG. 4 is a cross-sectional view of the outsole taken along the line 4-4 in FIG. 3 according to an embodiment of the present invention.
Figure 5:
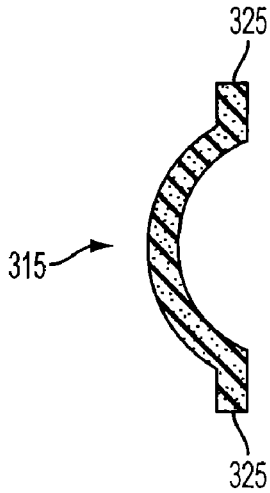
FIG. 5 is a cross-sectional view of the outsole taken along the line 5-5 in FIG. 3 according to an embodiment of the present invention.

With reference to FIGS. 3, 4, and 5, outsole 135 comprises the part of the footwear that makes contact with the ground, and may be formed of a wear-resistant rubber or foam material. In one embodiment, outsole 135 may also be made from a clear crystalline rubber material so that intermediate sole 130 is visible to the wearer through outsole 135. As would be apparent to one of skill in the art, outsole 135 may be formed with tread patterns such as grooves, indentations, or cleats on bottom surface 225. In some embodiments, such tread patterns can enhance traction or enhance muscle activity of a wearer such as by increasing the intermediate sole's resistance to compression.

In some embodiments, outsole 135 includes a primary ground contacting surface and a secondary ground contacting surface. As that term is used herein, primary ground contacting surface means the portion(s) of a shoe sole in contact with a level ground surface during an average natural gait cycle. The primary ground contacting surface generally corresponds to regions of the sole lying under the heel and under the metatarsal heads. "Secondary ground contacting surface," as that term is used herein, means the portion(s) of a shoe sole that may occasionally make contact with a ground surface during an average natural gait cycle or that may regularly make contact with a ground surface during an atypical gait cycle.

Outsole 135 has a heel portion 305 and a forefoot portion 310. A generally flat perimeter 325 can extend inward from the edge of outsole around both the heel and forefoot portions. The perimeter 325 may be substantially flat so as to create a platform surface. Although, in some embodiments (not illustrated), outsole does not include a flat perimeter such as perimeter 325. Bottom surface 225 can include at least one heel bulge 315 corresponding to at least one heel cavity 230 and at least one forefoot bulge 320 corresponding to at least one forefoot cavity 240. In one specific embodiment, bottom surface 225 includes only one heel bulge 315 corresponding to only one heel cavity 230 and only one forefoot bulge 320 corresponding to only one forefoot cavity 240. In each of these embodiments, these convex bulges can extend away from the flat perimeter 325. These bulges have a curved shape, and each bulge reaches its maximum vertical displacement from perimeter 325 at a point that lies generally in the center of the bulge. In one embodiment, bulges 315 and 320 reach maximum vertical displacement from perimeter 325 at a point that lies generally on the longitudinal axis of the shoe. In one embodiment, the vertical displacement between flat perimeter 325 and bulges 315 and 320 increases from flat perimeter 325 to the longitudinal axis of the shoe. In a heel to toe direction, the vertical displacement may increase from the rear and forward perimeter of each bulge to the center of each bulge.

In embodiments of the present invention including a primary ground contacting surface and a secondary ground contacting surface, the forefoot portion of the primary ground contacting surface may include the outsole covering bulge 320 and a portion of the edge of outsole 135 and perimeter 325. The heel portion of the primary ground contacting surface may include the outsole covering bulge 315 and a portion of the edge of outsole 135 and perimeter 325. The forefoot portion of the secondary ground contacting surface may include at least a portion of the edge of outsole 135 and perimeter 325, which may extend from the edge to the forefoot bulge about the perimeter of the forefoot portion. The heel portion of the primary ground contacting surface may include at least a portion of the edge of outsole 135 and perimeter 325, which may extend from the edge to the heel bulge about the perimeter of the heel portion.

In one embodiment, an article of footwear includes a sole having a forefoot portion and a heel portion, the sole comprising a midsole, an intermediate sole, and a primary ground contacting surface, wherein at least a portion of the intermediate sole extends from the midsole such that a forefoot bulge substantially covers the forefoot portion of the primary ground contacting surface and a heel bulge substantially covers the heel portion of the primary ground contacting surface. The article of footwear can further comprise a secondary ground contacting surface. In some embodiments, the forefoot portion of the secondary ground contacting surface comprises an edge and a platform surface extending from the edge to the forefoot bulge about the perimeter of the forefoot portion, wherein the platform surface is substantially flat relative to the forefoot bulge. In some embodiments, the heel portion of the secondary ground contacting surface comprises an edge and a platform surface extending from the edge to the heel bulge about the perimeter of the heel portion, wherein the platform surface is substantially flat relative to the heel bulge. In yet other embodiments, the forefoot portion of the secondary ground contacting surface comprises an edge and a platform surface extending from the edge to the forefoot bulge about the perimeter of the forefoot portion, wherein the platform surface is flat relative to the forefoot bulge, and the heel portion of the secondary ground contacting surface comprises an edge and a platform surface extending from the edge to the heel bulge about the perimeter of the heel portion, wherein the platform surface is substantially flat relative to the heel bulge.

The generally convex shape and steady curvature of heel bulge 315 and forefoot bulge 320, together with the resiliency provided by intermediate sole 130 may create a slight rocking motion, or instability, during the gait cycle in both a medial to lateral direction and a heel to toe direction. The wearer's body may work to stabilize the gait, and by forcing the wearer's body to do so, the shoe may trigger increased training to the muscles such as those muscles in the wearer's calves, thighs, lower back, buttocks, and/or abdomen.

An embodiment of a midsole for use in the article of footwear is shown in FIGS. 6 through 9. Midsole 120 may comprise any suitable midsole material, including, but not limited to, a foam such as ethylene vinyl acetate (EVA) or polyurethane. In some embodiments, the midsole can include a molded thermoplastic component such as, for example, an injection molded TPU component. Midsole 120 may be molded using known techniques including, but not limited to, die cutting, injection molding, compression molding, and open pouring.

In the embodiment illustrated in FIGS. 6 through 9, midsole 120 comprises a contoured cushioning layer that is structured to provide a support base for cradling a foot on its top surface 210 and receiving intermediate sole 130 on its bottom surface 215. As shown in FIG. 6, the bottom surface of the midsole includes heel cavity 600, passageway cavity 605, and forefoot cavity 610 formed therein. A raised portion 615 extends from the forefoot to cover a portion of the toe region. Cavities 600, 605, and 610 are sized to receive a portion of intermediate sole 130. However, cavities 600, 605, and 610 could be formed in different shapes and/or depths depending on the size and shape of the intermediate sole 130. Further, midsole 120 could be formed without passageway cavity 605 and/or raised portion 615. The midsole may also include a cavity to house a shank or arch stiffener, not shown.

Cavities 600 and 610 are formed such that they do not accommodate all of intermediate sole 130. In embodiments of the present invention which include perimeter 325, intermediate sole 130 may extend beyond the level of the perimeter surface. In one embodiment, intermediate sole 130 extends beyond the level of the perimeter 325 by at least about 2 millimeters, such as by at least about 5 millimeters. In embodiments of the present invention which include resilient insert 200, cavities 600 and 610 are formed such that they do not accommodate the entire volume of heel chamber 255 and forefoot chamber 275.

The depth of the cavities permits the resilient insert to be "pre-loaded" in the shoe during the typical gait phase of a wearer's motion. More particularly, because heel and forefoot chambers 255 and 275 of resilient insert 200 extend convexly beyond the opening of the midsole cavities 600 and 610, chambers 255 and 275 may receive impact forces before the shoe makes full contact with the ground (or the wearer's heel strikes the heel of the midsole). As a result, the fluid transfer process between heel and forefoot chambers of resilient insert 200 is initiated or advanced before a force is fully applied to the shoe sole to ensure that a sufficient amount of fluidic cushioning and support is provided to the foot of the wearer at all stages of the gait cycle.

The depth of cavities 600 and 610 and the presence of the intermediate sole therein can aid in maintaining the shape of heel and forefoot bulges 315 and 320 in the outsole. Because a portion of heel and forefoot chambers 255 and 275 of resilient insert 200 are thus housed in the heel and forefoot cavities 230 and 240 of the outsole, bulges 315 and 320 can maintain at least some curvature during the gait cycle. As discussed above, when curvature is maintained in outsole bulges 315 and 320 via the intermediate sole, a wearer's muscles may be forced to exert themselves more strenuously, or different muscles can be activated, to stabilize the gait. By adjusting the volume of resilient insert 200 that is accommodated in midsole cavities 600 and 610, it is possible to change the amount and/or rate at which forefoot bulge 320 and heel bulge 315 collapse as force is applied to the sole.

It is thought that forming the sole such that heel and forefoot cavities 600 and 610 are more shallow, and thus accommodate a smaller proportion of the intermediate sole (e.g., resilient insert 200), can force a wearer's muscles to work to stabilize the gait.

In contrast, it is thought that forming the sole such that heel and forefoot cavities 600 and 610 are deeper, and thus accommodate a larger proportion of the intermediate sole, can provide more stability and thereby require less, or even no, work by the wearer's muscles to stabilize the gait.

Alternatively, by adjusting the volume of the intermediate sole (e.g., resilient insert 200) or the pressure within the intermediate sole, the volume or the firmness of the intermediate sole can be changed to affect the amount or type of muscle exertion needed to stabilize a wearer's gait. For example, the volume of a resilient insert or the pressure of air inside a resilient insert could be increased by inflating it with air, thereby increasing the volume of the resilient insert outside the midsole cavities or increasing the firmness of the resilient insert and thus changing the amount or type of muscle exertion needed to stabilize a wearer's gait. In some embodiments, the volume of a resilient insert or the pressure of air inside a resilient insert can be decreased to stabilize the shoe and the volume of a resilient insert or the pressure of air inside a resilient insert can be increased to create instability in the shoe.

In some embodiments of the present invention, heel cavity 600 is sized to accommodate no more than about 60% by volume of a heel portion of the intermediate sole (e.g., heel chamber 255 of resilient insert 200). In other embodiments, heel cavity 600 is sized to accommodate no more than about 50% by volume of a heel portion of the intermediate sole. For example, heel cavity 600 can be sized to accommodate about 40% to about 50% or about 45% to about 50% by volume of a heel portion of the intermediate sole.

Likewise, forefoot cavity 610 can be sized to accommodate no more than about 60% by volume of a forefoot portion of the intermediate sole (e.g., forefoot chamber 275 of resilient insert 200). In other embodiments, forefoot cavity 610 is sized to accommodate no more than about 50% by volume of a forefoot portion of the intermediate sole. For example, forefoot cavity 610 can be sized to accommodate about 40% to about 50% or about 45% to about 50% by volume of a forefoot portion of the intermediate sole.

In one particular embodiment, heel cavity 600 is sized to accommodate about 50% by volume of a heel portion of the intermediate sole (e.g., heel chamber 255 of resilient insert 200) and forefoot cavity 610 is sized to accommodate less than about 50% by volume of a forefoot portion of the intermediate sole.

The depth of cavities 600 and 610 may be modified to accommodate a greater or lesser volume of the intermediate sole without departing from the scope of the invention such that portions of the heel and forefoot chambers extend beyond the heel and forefoot cavities to provide the desired stability and corresponding exertion level for the wearer.

With reference to FIG. 3, intermediate sole 130 extends from midsole 120 such that heel bulge 315 substantially covers heel portion 305 of outsole 135 and forefoot bulge 320 substantially covers forefoot portion 310. In one embodiment, this may result in forefoot bulge 320 covering greater than about 30%, greater than about 50%, greater than about 75%, greater than about 90%, or substantially all of outsole forefoot portion 310 and heel bulge 315 covering greater than about 50%, greater than about 75%, greater than about 90%, or substantially all of outsole heel portion 305. It is contemplated that the size of bulges 320 and 315 may be modified to provide the desired stability and corresponding exertion level for the wearer.

The intermediate sole can extend from the midsole such that a heel bulge substantially covers a heel portion of a ground contacting surface (e.g., a primary ground contacting surface) and a forefoot bulge substantially covers a forefoot portion of a ground contacting surface (e.g., a primary ground contacting surface). In some embodiments, this may result in a forefoot bulge covering greater than about 50%, greater than about 75%, greater than about 90%, or substantially all of a forefoot portion of the ground contacting surface (e.g., a forefoot portion of a primary ground contacting surface) and a heel bulge covering greater than about 50%, greater than about 75%, greater than about 90%, or substantially all of a heel portion of the ground contacting surface (e.g., a heel portion of a primary ground contacting surface).

In some embodiments, an article of footwear includes a sole having a forefoot portion and a heel portion, the sole comprising a midsole, an intermediate sole, and a ground contacting surface (e.g., a primary ground contacting surface), wherein at least a portion of the intermediate sole is disposed in the midsole and at least half of the intermediate sole extends from the midsole in the forefoot portion and the heel portion such that only one forefoot bulge is disposed in the forefoot portion of the ground contacting surface and only one heel bulge is disposed in the heel portion of the ground contacting surface. It is believed that embodiments of the present invention containing only one forefoot bulge and only one heel bulge can provide a characteristic wear feel, can increase the exertion required of the wearer, and/or can increase muscle activity of the wearer as compared to footwear containing multiple bulges disposed in either the forefoot or heel portion of the ground contacting surface due, in part, to the unstable ground contacting surface of such embodiments.

Figure 17A:
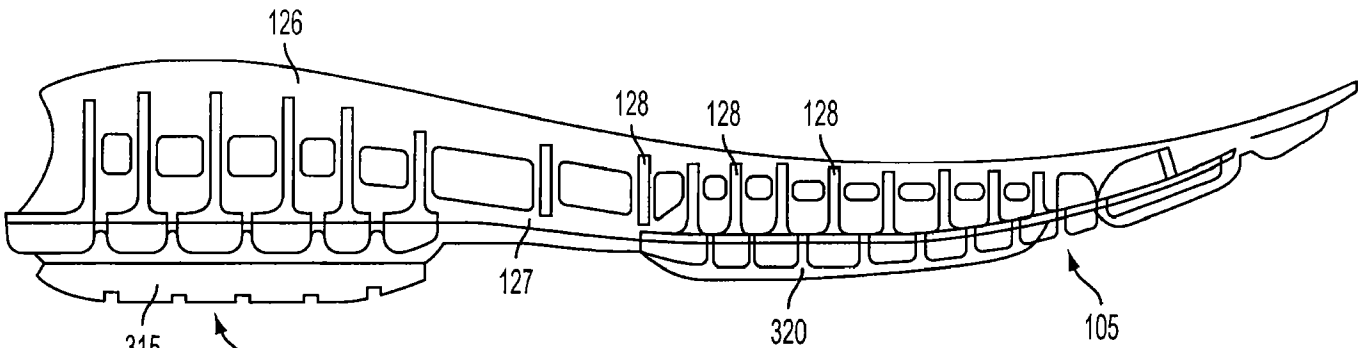
FIG. 17A is a medial side view of a skeletal support structure according to an embodiment of the present invention.
Figure 17B:
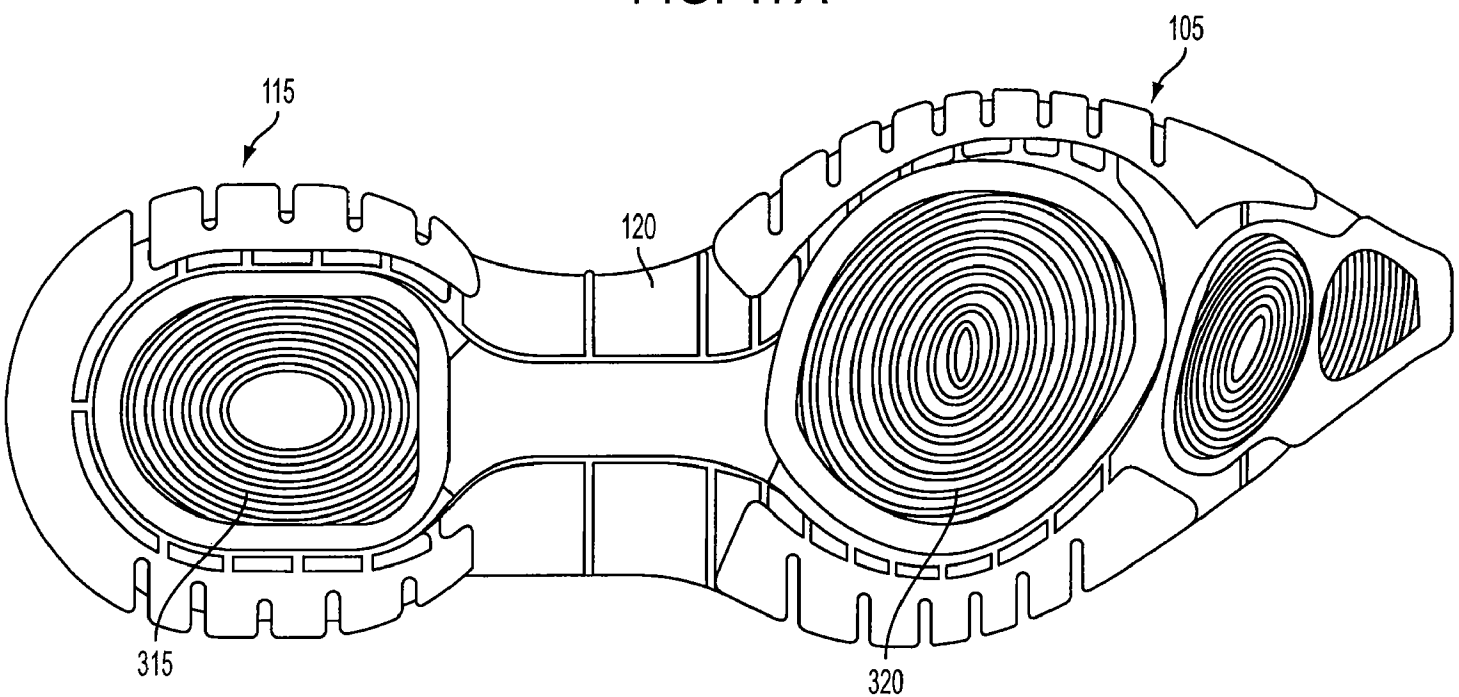
FIG. 17B is a bottom view of an outsole and midsole with a skeletal support structure according to an embodiment of the present invention.

With reference to FIGS. 17A and 17B, in one embodiment midsole 120 may comprise a skeletal support structure formed around the intermediate sole 130. The skeletal support structure may comprise a top plate 126 and a bottom plate 127, and a plurality of vertical supports 128 may extend between the top and bottom plates. Top plate 126 may be shaped to provide a support base for cradling a foot. The support structure may comprise TPU or other suitable material for providing support to the overall structure of the midsole. In one embodiment, top plate 126, bottom plate 127, and vertical supports 128 may be molded as a unitary piece. In alternative embodiments, one or more of the components may be molded separately. In one embodiment, midsole 120 may further comprise additional material, such as, for example, EVA foam in addition to the skeletal support structure to provide additional cushioning properties to the midsole.

Figure 18:
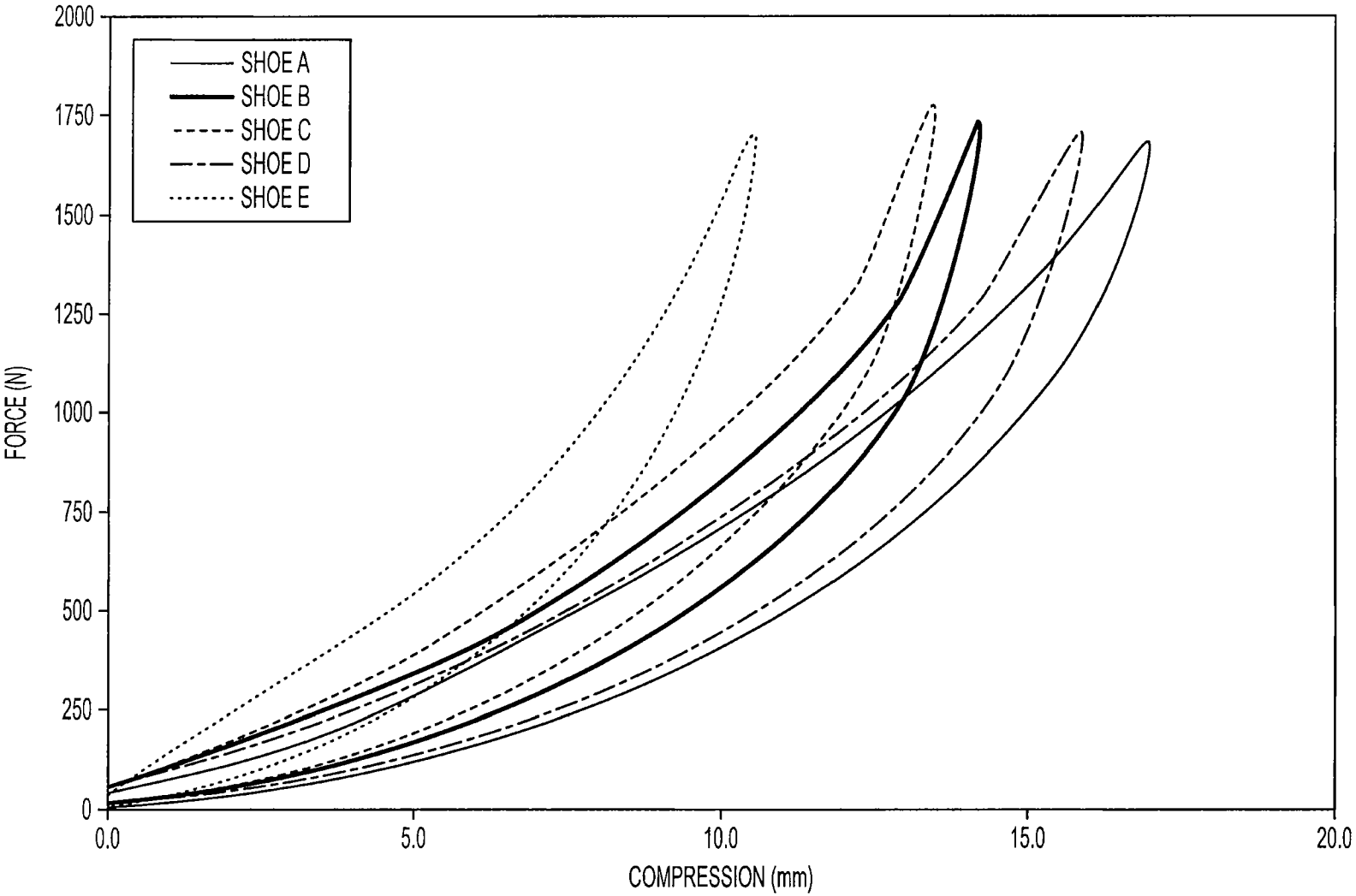
FIG. 18 is a chart depicting an exemplary force-compression curve of an article of footwear according to an embodiment of the present invention.

FIG. 18 is a chart depicting an exemplary heel region force-compression curve of an article of footwear according to an embodiment of the present invention. Shoes "A," "B," "C," and "D" each contain a resilient insert similar to that shown in FIG. 10. An embodiment of shoe "A" is depicted in FIGS. 1-9. Shoe "B" is the REEBOK® Voyage Low IV. Shoe "C" is the REEBOK® Versa Cushion DMX II. Shoe "D" is the REEBOK® Rainwalker VIII. Shoe E is the REEBOK® Express Walk RG, and does not contain a resilient insert. FIG. 18 illustrates that Shoe "A," which contains a similar resilient insert as Shoes "B"-"D," but which has a different midsole construction from those shoes, absorbed more energy during heel region force-compression testing. Accordingly, it is believed that the increased energy absorption of shoes of embodiments of the present invention, as embodied by Shoe "A," can provide a characteristic wear feel, can increase the exertion required of the wearer, and/or can increase muscle activity of the wearer.

As discussed above, intermediate sole 130 may comprise one or more of a variety of materials and constructions. By altering the hardness of intermediate sole 130, it is possible to change the rate at which forefoot bulge 320 and heel bulge 315 distort as force is applied to the sole. Using a relatively soft insert in intermediate sole 130 can cause the bulges to distort from their curved shape during walking or running, thereby providing more sole-to-ground contact. This may result in more stability and a less strenuous workout. In contrast, using a relatively firm insert can cause the bulges to retain their curved shape to a greater extent, and can force the wearer's muscles to exert themselves to stabilize the gait.

As noted elsewhere, these example embodiments have been described for illustrative purposes only, and are not limiting. Other embodiments are possible and are covered by the methods and systems described herein. Such embodiments will be apparent to persons skilled in the relevant art(s) based on the teachings contained herein. Thus, the breadth and scope of the methods and systems described herein should not be limited by any of the above-described exemplary embodiments, but should be defined only in accordance with the following claims and their equivalents.

What is claimed is:

1. An article of footwear, comprising:

a sole comprising:

a midsole, a bottom surface including a platform surface, and an intermediate sole disposed between said midsole and said bottom surface, wherein at least a portion of said intermediate sole extends from said midsole in the form of at least one chamber, wherein said bottom surface defines only one forefoot bulge in a forefoot portion of said bottom surface, wherein said bottom surface defines only one heel bulge in a heel portion of said bottom surface, wherein the forefoot bulge extends below the platform surface, and wherein the forefoot bulge substantially covers the forefoot portion of the bottom surface.

2. The article of footwear of claim 1, wherein at least a portion of said intermediate sole is disposed in said midsole and at least half of said intermediate sole extends from said midsole in the forefoot portion and the heel portion.

3. The article of footwear of claim 1, wherein said intermediate sole is disposed in said midsole such that more of said intermediate sole extends from said midsole than is disposed in said midsole.

4. The article of footwear of claim 1, wherein said intermediate sole comprises a resilient insert.

5. The article of footwear of claim 4, wherein the resilient insert is fluid-filled.

6. The article of footwear of claim 5, wherein the resilient insert contains air at ambient pressure.

7. The article of footwear of claim 5, wherein the resilient insert comprises a forefoot chamber and a heel chamber in fluid communication with the forefoot chamber.

8. The article of footwear of claim 1, wherein said intermediate sole comprises foam.

9. The article of footwear of claim 1, wherein said intermediate sole comprises foam having a different density than the density of said midsole.

10. The article of footwear of claim 1, wherein said intermediate sole comprises a bladder.

11. The article of footwear of claim 1, wherein the distance between said midsole and said bottom surface in both the forefoot portion and the heel portion generally increases from a perimeter of said bottom surface towards a center longitudinal axis of said bottom surface.

12. The article of footwear of claim 1, wherein said midsole comprises a top surface and a bottom surface, the bottom surface having a midsole cavity including a forefoot cavity and a heel cavity.

13. The article of footwear of claim 12, wherein said intermediate sole is partially disposed in the midsole cavity.

14. The article of footwear of claim 12, wherein at least half of said intermediate sole extends below the bottom surface of said midsole.

15. The article of footwear of claim 12, wherein said intermediate sole comprises a resilient insert having a forefoot chamber partially disposed in the forefoot cavity and a heel chamber partially disposed in the heel cavity.

16. The article of footwear of claim 15, wherein the heel cavity is sized to accommodate no more than about 50% of the heel chamber by volume.

17. The article of footwear of claim 15, wherein the forefoot cavity is sized to accommodate no more than about 50% of the forefoot chamber by volume.

18. The article of footwear of claim 1, the heel bulge extends below the platform surface.

19. The article of footwear of claim 18, wherein the forefoot bulge and the heel bulge extend more than about 5 millimeters below the platform surface.

20. The article of footwear of claim 1, wherein the forefoot bulge and the heel bulge are convex and have a continuous curvature.

21. The article of footwear of claim 1, further comprising a secondary ground contacting surface, wherein the forefoot portion of the secondary ground contacting surface comprises an edge and a platform surface extending from the edge to the forefoot bulge about the perimeter of the forefoot portion, and wherein the platform surface is substantially flat relative to the forefoot bulge.

22. The article of footwear of claim 1, further comprising a secondary ground contacting surface, wherein the heel portion of the secondary ground contacting surface comprises an edge and a platform surface extending from the edge to the heel bulge about the perimeter of the heel portion, and wherein the platform surface is substantially flat relative to the heel bulge.

23. The article of footwear of claim 1, wherein the forefoot bulge covers greater than about 75% of the area of the forefoot portion of said bottom surface.

24. The article of footwear of claim 1, wherein the heel bulge covers greater than about 75% of the area of the heel portion of said bottom surface.

25. The article of footwear of claim 1, wherein said forefoot bulge defines a continuous perimeter and corresponds to a forefoot chamber of the intermediate sole, wherein said heel bulge defines a continuous perimeter and corresponds to a heel chamber of said intermediate sole, and wherein the vertical displacement of each of said forefoot bulge and said heel bulge increases from the continuous perimeter of each bulge to the center of each bulge.

26. The article of footwear of claim 1, wherein the forefoot bulge covers greater than about 30% of the forefoot portion of the bottom surface.

27. An article of footwear, comprising:

a sole having a forefoot portion and a heel portion, said sole comprising a midsole, an intermediate sole, and a ground contacting surface, wherein the ground contacting surface includes a platform surface disposed about a perimeter of the forefoot portion, wherein at least a portion of said intermediate sole is disposed in said midsole and at least half of said intermediate sole extends from said midsole in the forefoot portion and the heel portion such that only one forefoot bulge is disposed in the forefoot portion of said ground contacting surface and only one heel bulge is disposed in the heel portion of said ground contacting surface, wherein the platform surface is substantially flat, wherein the forefoot bulge extends below the platform surface, and wherein the forefoot bulge substantially covers the forefoot portion of said ground contacting surface.

28. The article of footwear of claim 27, wherein the heel bulge substantially covers the heel portion of said ground contacting surface.

29. The article of footwear of claim 27, wherein the forefoot portion of the ground contacting surface comprises an edge and a platform surface extending from the edge to the forefoot bulge about the perimeter of the forefoot portion, and wherein the platform surface is substantially flat relative to the forefoot bulge, and wherein the heel portion of the ground contacting surface comprises an edge and a platform surface extending from the edge to the heel bulge about the perimeter of the heel portion, and wherein the platform surface is flat relative to the heel bulge.

30. The article of footwear of claim 27, wherein said intermediate sole comprises a fluid-filled resilient insert.

31. The article of footwear of claim 30, wherein the resilient insert comprises a forefoot chamber and a heel chamber in fluid communication with the forefoot chamber.

32. The article of footwear of claim 31, wherein the forefoot chamber corresponds with the forefoot bulge and the heel chamber corresponds with the heel bulge.

33. The article of footwear of claim 32, wherein said midsole comprises a forefoot cavity formed in the forefoot portion of said midsole and a heel cavity formed in the heel portion of said midsole, and wherein the forefoot chamber is partially disposed in the forefoot cavity and the heel chamber is partially disposed in the heel cavity.

34. The article of footwear of claim 33, wherein the heel cavity is sized to accommodate no more than about 50% of the heel chamber by volume.

35. The article of footwear of claim 33, wherein the forefoot cavity is sized to accommodate no more than about 50% of the forefoot chamber by volume.

36. The article of footwear of claim 30, wherein the resilient insert contains air at ambient pressure.

37. The article of footwear of claim 27, wherein said intermediate sole comprises foam.

38. An article of footwear, comprising:

a sole having a forefoot portion and a heel portion, said sole comprising:

a midsole having a cavity formed therein, a resilient insert partially disposed in the midsole cavity, the resilient insert having a forefoot chamber, a heel chamber, and a passageway fluidly connecting the forefoot chamber and the heel chamber, and a ground contacting surface, wherein a greater portion of said resilient insert than the portion disposed in the midsole cavity extends from said midsole in the forefoot portion and the heel portion such that a forefoot bulge corresponding with the forefoot chamber substantially covers the forefoot portion of said ground contacting surface and a heel bulge corresponding with the heel chamber substantially covers the heel portion of said ground contacting surface, and wherein a forefoot portion of said ground contacting surface comprises an edge and a platform surface extending from the edge to the forefoot bulge about the perimeter of the forefoot portion, and wherein the platform surface is substantially flat relative to the forefoot bulge.

* * * * *

UNITED STATES PATENT AND TRADEMARK OFFICE

CERTIFICATE OF CORRECTION

PATENT NO. : 8,307,569 B2
APPLICATION NO. : 12/416698
DATED : November 13, 2012
INVENTOR(S) : McInnis et al.

It is certified that error appears in the above-identified patent and that said Letters Patent is hereby corrected as shown below:

In column 13, line 26 (claim 18), “the heel bulge” should read --wherein the heel budge--.

Signed and Sealed this
Nineteenth Day of February, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,307,569 B2
APPLICATION NO. : 12/416698
DATED : November 13, 2012
INVENTOR(S) : McInnis et al.

It is certified that error appears in the above-identified patent and that said Letters Patent is hereby corrected as shown below:

In the Claims:

In column 13, line 26 (claim 18), “the heel bulge” should read --wherein the heel bulge--.

This certificate supersedes the Certificate of Correction issued February 19, 2013.

Signed and Sealed this
Thirtieth Day of April, 2013

Teresa Stanek Rea
*Acting Director of the United States Patent and Trademark Office*